US008721263B2

(12) United States Patent
Schmidt

(10) Patent No.: US 8,721,263 B2
(45) Date of Patent: May 13, 2014

(54) CENTRIFUGAL PUMP

(75) Inventor: Jorgen Schmidt, Hadsund (DK)

(73) Assignee: Grundfos Management a/s, Bjerringbro (DK)

( * ) Notice: Subject to any disclaimer, the term of this patent is extended or adjusted under 35 U.S.C. 154(b) by 581 days.

(21) Appl. No.: 13/054,585

(22) PCT Filed: Jun. 30, 2009

(86) PCT No.: PCT/EP2009/004688
§ 371 (c)(1),
(2), (4) Date: Jan. 18, 2011

(87) PCT Pub. No.: WO2010/009799
PCT Pub. Date: Jan. 28, 2010

(65) Prior Publication Data

US 2011/0123317 A1 May 26, 2011

(30) Foreign Application Priority Data

Jul. 25, 2008 (EP) ..... 08013390

(51) Int. Cl.
*F04D 29/16* (2006.01)

(52) U.S. Cl.
USPC ..... 415/113; 415/172.1; 415/174.2; 415/174.3; 416/185

(58) Field of Classification Search
USPC ..... 415/110, 111, 113, 170.1, 172.1, 174.2, 415/174.3, 168.1, 168.2; 416/179, 182, 416/185, 186 R, 187
See application file for complete search history.

(56) References Cited

U.S. PATENT DOCUMENTS

| | | | | | |
|---|---|---|---|---|---|
| 2,109,679 | A * | 3/1938 | Neveling, Sr. | ..... | 384/132 |
| 2,140,644 | A * | 12/1938 | McHugh | ..... | 403/377 |
| 2,250,311 | A * | 7/1941 | Meyer | ..... | 277/390 |
| 2,452,253 | A * | 10/1948 | McGill | ..... | 418/142 |
| 3,020,850 | A | 2/1962 | Meckenstock | | |
| 6,679,678 | B2 * | 1/2004 | Giesler et al. | ..... | 415/112 |
| 2001/0007632 | A1 | 7/2001 | Pesek et al. | | |
| 2004/0156711 | A1 * | 8/2004 | Quinn | ..... | 415/170.1 |
| 2006/0147328 | A1 | 7/2006 | Ito et al. | | |
| 2007/0160467 | A1 | 7/2007 | Lienau et al. | | |

FOREIGN PATENT DOCUMENTS

| | | | |
|---|---|---|---|
| EP | 257358 | A2 * | 3/1988 |
| GB | 730459 | A | 5/1955 |

OTHER PUBLICATIONS

Int'l Search Report issued on Aug. 14, 2009 in Int'l Application No. PCT/EP2009/004688.

* cited by examiner

*Primary Examiner* — Edward Look
*Assistant Examiner* — Danielle M Christensen
(74) *Attorney, Agent, or Firm* — Panitch Schwarze Belisario & Nadel LLP

(57) ABSTRACT

A centrifugal pump includes at least one impeller (4) and at least one sealing arrangement arranged between the impeller (4) and a housing wall. The sealing arrangement seals a suction side of the impeller (4) with respect to a pressure side of the impeller (4). The sealing arrangement including a seal (12) fastened on the impeller (4) in a rotationally fixed manner.

12 Claims, 4 Drawing Sheets

CENTRIFUGAL PUMP

CROSS-REFERENCE TO RELATED APPLICATIONS

This application is a section 371 of International Application No. PCT/EP2009/004688, filed Jun. 30, 2009, which was published in the English language on Jan. 28, 2010 under International Publication No. WO 2010/009799 A1 and the disclosure of which is incorporated herein by reference.

BACKGROUND OF THE INVENTION

The present invention relates to a centrifugal pump.

Centrifugal pumps comprise a gap between the rotating impeller and the stationary pump part surrounding the impeller. Gap seals are provided, in order to reduce leakage losses from the impeller pressure side to the impeller suction side, which occur at the gap.

Such gap seals are known from U.S. Patent Application Publication Nos. 2006/0147328 A1 and 2007/0160467 A1. The gap seals described there are attached on a stationary pump part which separates the impeller pressure side from the impeller suction side. Typically, despite the gap seal, there exists a gap between the stationary pump part and the impeller which rotates relative thereto. The width of this gap may be designed such that no significant leakage loss may occur, but then there exists the danger of friction between the impeller and the gap seal, which may lead to a wear of the participating friction partner, as well as particularly unfavorably to a blocked pump. Accordingly, with the known centrifugal pumps, a dilemma exists, with regard to a narrow gap causing a minimal leakage, of having to accept a comparatively large wear and a blockage of the pump, or on the other hand with regard to a larger gap, although having a lower wear, of having to accept a relatively large leakage loss.

Against this background, it is an objective of the present invention to provide a centrifugal pump with a gap seal, which should have good wear characteristics with an as low as possible leakage from the impeller pressure side to the impeller suction side.

BRIEF SUMMARY OF THE INVENTION

The above objective is achieved by a centrifugal pump with the features specified in the independent claim(s) of the present application. Advantageous further formations of the invention are to be deduced from the dependent claims, the subsequent description as well as the drawings.

The centrifugal pump according to a preferred embodiment of the present invention comprises at least one impeller and at least one sealing arrangement which is arranged between a housing wall of the pump housing and the impeller and thus seals the suction side of the impeller with respect to the pressure side of the impeller. According to the present invention, one envisages the sealing arrangement comprising a seal which is fastened on the impeller in a rotationally fixed manner.

For example, the sealing of the suction side of the impeller with respect to its pressure side is effected between the seal and the stationary housing wall or a sealing body arranged on the housing wall, wherein the seal co-rotates with the impeller. Accordingly, no relative movement between the impeller and the seal occurs in the rotation direction of the impeller. One advantage of this design is that in this manner, the impeller does not form a friction partner with a stationary pump part, so that the impeller is not subjected to abrasive wear.

Further, the inventive arrangement of the seal on the impeller, in a particularly favorable manner, permits the seal to not only be designed as a radial seal, but particularly advantageously as an axial seal, which is described in yet more detail hereinafter with the advantages which this entails.

The seal is preferably arranged displaceable in the radial direction relative to the impeller, on the impeller. The seal is particularly advantageously attached on the impeller in a manner such that it may move radially in essentially any direction transversely to a middle axis of the impeller. This permits a narrow design of the necessary gap between the seal rotating with the impeller, and the stationary part of the sealing arrangement, since the seal, e.g., may perform a yielding movement which briefly enlarges the gap, when a foreign body has penetrated into the gap or when the seal contacts the stationary part of the sealing arrangement on account of a sagging of the impeller shaft. For example, the radial distance of the seal to the stationary part of the sealing arrangement at the location, at which it contacts the stationary part or at which a foreign body is located, may be increased by way of a radial displacement of the seal relative to the impeller, in a manner such in the most favorable case, no abrasive wear on the seal and/or the stationary part of the sealing arrangement occurs.

The present invention, in a further advantageous design, moreover envisages designing the seal in a flexible manner at least in sections, with the aim of further reducing the danger of an abrasive wear. Accordingly, the seal, preferably in at least one section which borders the gap with the stationary part of the sealing arrangement, has an elastic deformability and preferably an elastic flexibility. Thereby, it is preferably the case of a deformability transverse to its sealing surface with the stationary part of the sealing arrangement. This elasticity likewise permits a yielding movement of the seal, given a sagging of the impeller shaft or given a foreign body which has penetrated into the sealing arrangement.

As already mentioned, it has been found to be particularly advantageous if the seal is designed as an axial seal, wherein an axial seal in the context of the invention is to be understood as such a seal, with which the sealing is effected in the axial direction of the impeller, i.e., that the sealing surfaces extend in the axial direction of the impeller. One design is preferred, with which the seal is arranged on a suction port of the impeller, wherein it has a hollow-cylindrical section which extends in the axial direction of the impeller. The suction port of the impeller is typically designed centrally on a cover disk of the impeller, said cover disk being at the front in an inflow direction. The seal is preferably attached at the edge of the cover disk, said edge delimiting the suction port, in a manner such that the inner wall of the hollow-cylindrical section, said inner wall preferably forming a sealing surface of the sealing arrangement, is essentially flush with the edge of the suction port.

Hereby, advantageously a stationary part of the sealing arrangement, and which is designed in a sleeve-like manner and is usefully arranged on the housing of the centrifugal pump or on its housing wall, may engage into the hollow-cylindrical section of the seal.

The outer cross section or the outer diameter of the sleeve-like part of the sealing arrangement and which engages into the hollow-cylindrical section of the seal arranged on the impeller side, usefully corresponds to the inner cross section or the inner diameter of the hollow-cylindrical section of the seal, wherein a gap which is formed between the sleeve-like part and the hollow-cylindrical section of the seal, may advantageously be relatively narrow. Accordingly, only relatively low leakages may occur at the gap. With regard to these leakages, it has further been found to be advantageous for the gap, at least in an end section, to extend in the inflow direction of the fluid suctioned by the pump and to be open towards the suction port, so that occurring leakage fluid may also be suctioned directly again via the suction port.

A particularly small gap width may be achieved if the impeller-side seal, as already described, is designed in a flexible manner at least in sections and/or this seal is displaceable relative to the impeller in the radial direction. These designs have the effect that the impeller-side seal, in the case of friction with the housing-side, sleeve-like part of the sealing arrangement, may move from this sleeve-like part in the radial direction, i.e., may radially depart from this part. The housing-side part of the sealing arrangement and the seal may thus automatically align to one another.

The ability of the impeller-side seal to be able to displace in the radial direction of the impeller, relative to the impeller, has also been found to be advantageous inasmuch as a gap between the impeller-side and the housing-side seal results, which narrows in the radial direction, similarly to a hydrodynamic sliding bearing, by way of such a displacement of the impeller-side seal. This wedge-like gap leads to a hydrodynamic pressure distribution in the gap, by which means a force is exerted onto the radially movable, impeller-side seal, and this force attempts to move the hollow-cylindrical section of the seal back into a concentric position to the housing-side, sleeve-like part of the sealing arrangement. Accordingly, the seal is capable of independently moving back into its normal position.

The seal may advantageously be fastened on the impeller with a preferably flexible fastening ring. Hereby, it has been found to be particularly useful, if a section of the impeller, preferably an axial end of the impeller, said end surrounding the suction port, and a section of the seal, said section contacting this section or this end, have an at least essentially corresponding outer cross section. The flexibility of the fastening ring hereby advantageously permits the fastening ring, amid stretching, to be applied in a simple manner around sections which contact one another, of the impeller and of the seal, and subsequently a clamping force to be exerted onto these sections, by which means the seal is fixed on the impeller with a positive fit and/or non-positive fit.

For fastening the seal on the impeller, preferably an end of the seal as well as an axial end of the impeller comprises a radially outwardly projecting flange-like widening, wherein for fastening, the two widenings together engage into an inner groove of the fastening ring applied around the widening. In this manner, the seal is not only fixed by the fastening ring with a positive fit in the radial direction, but also in the axial direction.

The fastening ring holds the seal preferably with radial play on the impeller. Thus, the fastening ring may for example comprise a widening formed on the end of the seal, wherein the widening has a small distance to the fastening ring in the radial direction, said distance advantageously permitting limited yielding movements of the sealing ring in the radial direction relative to the impeller.

Advantageously, the seal is connected to the impeller in a rotationally fixed manner via a positive-fit. This positive-fit may either be produced directly between the seal and the impeller or via the fastening ring by way of the engagement of at least one engagement means into at least one corresponding receiver for this engagement means, wherein it is basically infinite as regards on which component or on which components the engagement means are provided, and on which component or on which components receivers for these engagement means are provided.

In this context, one preferred design envisages at least one engagement means, which is engaged with a corresponding engagement means on the impeller, being formed at a side of the seal, said side facing the suction port. For example, the positive fit here is created directly between the seal and the impeller. Thus, recesses may be formed distributed over the periphery, e.g., on an annular end-face of the seal, the end-face contacting the impeller, while corresponding projections are formed on an impeller-side contact surface, which engage into the sealing-side recesses and fix the seal relative to the impeller in a rotationally fixed manner, wherein preferably a certain radial movement ability is retained. Of course, it is also possible for the projections to be provided on the seal side, and the recesses on the impeller side.

Apart from this, it may also be advantageous to form at least one radially aligned projection which engages into a corresponding radial recess of the suction port and/or seal, in the inner groove of the fastening ring. Typically, it is also reversely possible to provide a radially aligned recess in the inner groove of the fastening ring, into which recess a radially aligned projection of the suction port and/or seal engages. In both cases, a rotational movement of the seal relative to the impeller is prevented by the fastening ring. This is particularly advantageous when the fastening ring is formed of an elastic material, such as rubber for example, since with the torque transmission from the impeller onto the seal, possible impacts from the impeller onto the seal may occur, wherein the noise which is caused by way of this is damped by the elastic material of the fastening ring.

With a further preferred design of the centrifugal pump according to the present invention, one envisages connecting the seal to the suction port in a rotationally fixed manner by way of a non-positive fit. Thus, the impeller-side and the sealing-side contact surface and, as the case may be, furthermore also a fastening ring which serves for fastening the seal on the impeller, may in each case be designed for forming a friction fit.

In particular, when the centrifugal pump according to the present invention is a low-pressure pump, the seal and the fastening ring may advantageously be designed as an integral component. Accordingly, an annular section is provided on an axial end of the seal, and this section peripherally encompasses an axial end of the impeller. Preferably, the section forming the seal and the section of the component, said section forming the fastening ring, are hereby formed of an elastic material.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
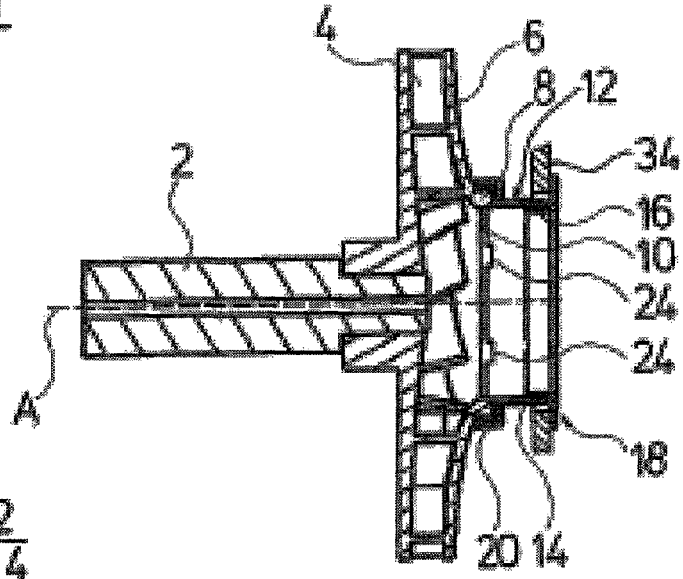
FIG. 1 is a schematic longitudinal section representation of an impeller of a centrifugal pump, with a sealing arrangement arranged thereon, in accordance with a first preferred embodiment of the present invention.

Certain terminology is used in the following description for convenience only and is not limiting. The word "front" designates a direction in the drawings to which reference is made. The words "inwardly" and "outwardly" refer to directions toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, FIGS. 1-8, in each case, show an impeller 4 of a centrifugal pump and which is driven via an impeller shaft 2. A suction port 10 is preferably formed at the axial end 8, on a front cover disk 6 of the impeller 4, i.e., on the cover disk 6 which is away from the impeller shaft 2. A seal 12 is arranged at the axial end 8 of the impeller 4. The seal 12 is formed of an elastic material, preferably rubber. The seal 12 comprises a hollow-clinical section 14 in the form of a base body 14 which is aligned axially and concentrically to a middle axis A of the impeller 4. The base body 14 forms an inflow channel to the suction port 10 of the impeller 4.

A rigid, sleeve-like section 16 of a sealing part 18 engages with little play, i.e., while forming a comparatively narrow gap, into the base body 14, at end of base body 14, said end being away from the impeller 4. The sealing part 18 is arranged in a fixed manner on a housing wall 34 which is not represented in the figures, of a pump housing which is likewise not represented, and forms a run-in to the suction port 10 of the impeller 4. Together, the impeller-side seal 12 and the sleeve-like section 16 of the housing-wall-side seal part 18, form a sealing arrangement which seals the suction side of the impeller 4 with respect to the pressure side of the impeller 4. Hereby, only a small quantity of fluid may flow from the pressure side of the impeller 4 to its suction side, on account of the narrow design of the gap between the base body 14 of the seal 12 and the housing-wall-side seal part 18, wherein it has been found to be particularly advantageous for the gap to extend between the base body 14 and the sleeve-like section 16 of the seal part 18, concentrically to the middle axis A of the impeller 4, directly in the direction of the suction port 10 of the impeller 4, so that the fluid which has exited may be immediately suctioned again by the impeller 4.

The axial end 8 of the impeller 4 around the suction port 10 is designed in a flange-like manner, wherein an end region which forms a bearing surface for the seal 14, is radially widened. The end of the seal 8, which is to be brought to bear on the end 8 of the impeller 4, is likewise widened in the radial direction, wherein the inner diameter and outer diameter of this widening 21 correspond to the respective diameters of the widening 19 formed at the end 8.

The fastening of the seal 12 at the end 8 of the impeller 4 is effected by way of a fastening ring 20. The fastening ring 20 is formed of elastic material, preferably rubber. A peripheral groove 22 is formed on its inner side. For fastening the seal 12 on the end 8 of the impeller 4, the fastening ring 20, while stretching, is applied peripherally around the end 8 of the impeller 4 and the seal 12, such that the widening 19 formed at the end 8, and the widening 21 formed on the seal 12, together engage into the groove 22 of the fastening ring 20, so that the fastening ring 20 encompasses these widenings 19 and 21 axially as well as peripherally, wherein a small play exists in the radial direction between the sealing-side widening 21 and the peripheral inner wall of the groove 22. This play, as the case may be, permits a yielding movement of the seal 12 relative to the sleeve-like section 16 of the seal part 18, transversely to the middle axis A of the impeller 4.

The seal 12 is fastened on the end 8 of the impeller 4 in the radial as well as axial direction by way of the fastening ring 22. Six projections 24 which extend in the axial direction, are formed on the outer end-side of the end 8 of the impeller 4, uniformly distributed over the periphery of this end-side, in order to prevent a rotational movement of the seal 12 relative to the impeller 4 about its middle axis A. Six recesses 26 corresponding to these projections 24 are formed at the end-side end of the widening 21 formed on the seal 12, into which recesses the projections 24 engage with a positive fit.

Figure 2:
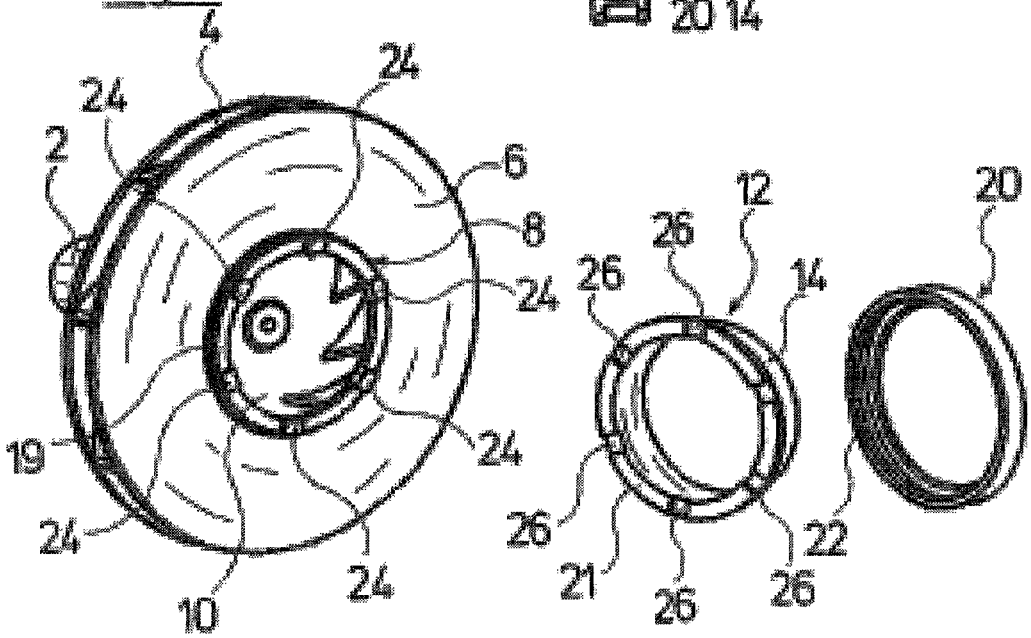
FIG. 2 is an exploded perspective representation of the impeller of FIG. 1.
Figure 3:
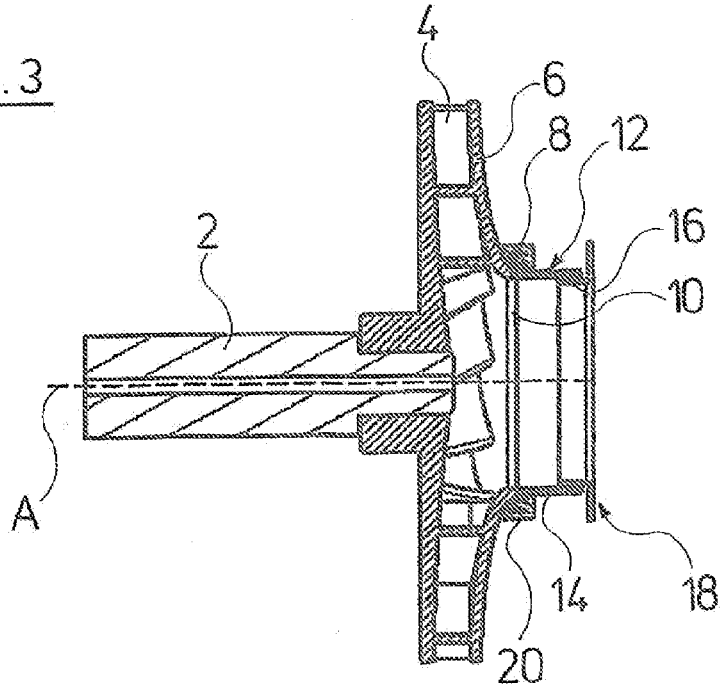
FIG. 3 is a schematic longitudinal section representation of an impeller of a centrifugal pump, with a sealing arrangement arranged thereon, in accordance with a second preferred embodiment of the present invention.
Figure 4:
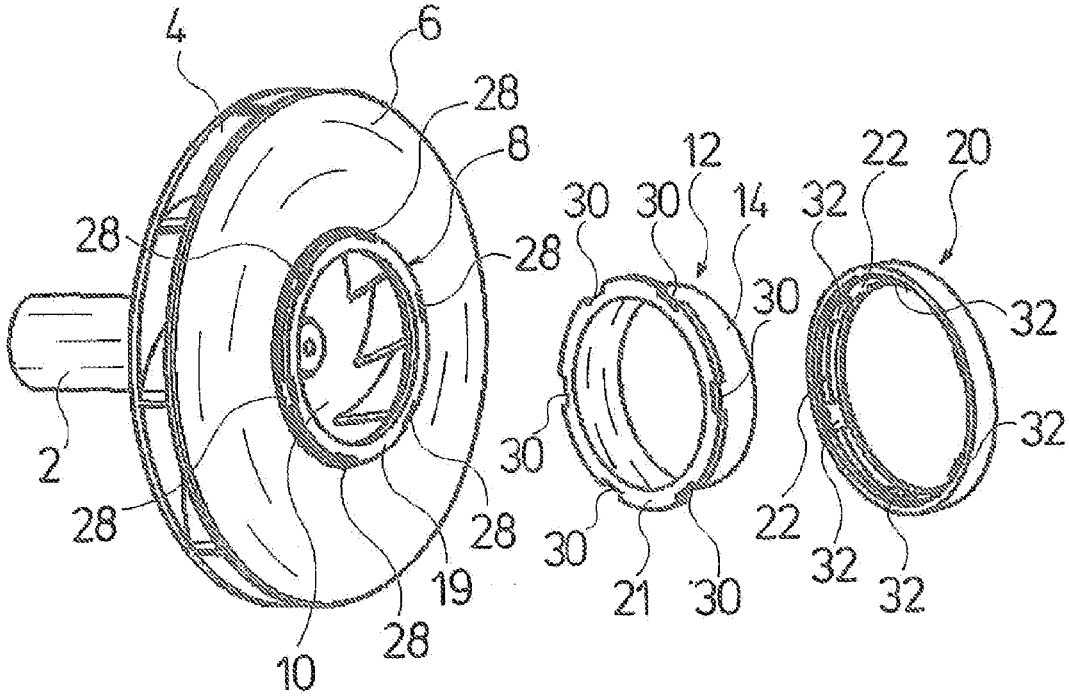
FIG. 4 is an exploded perspective representation of the impeller of FIG. 3.

The embodiment example represented in FIGS. 3 and 4 corresponds essentially to the embodiment example represented in FIGS. 1 and 2, wherein however no axially aligned projections 24 or recesses 26 are formed on the end-sides of the widening 19 formed at the end 8 and on the sealing-side widening 21. Instead, six radially aligned recesses 28 distributed uniformly over the periphery, are arranged peripherally on the widening 19 which is formed at the end 8, and likewise six radially aligned recesses 30 distributed uniformly over the periphery, are arranged on the widening 21 which is formed on the seal 12, wherein the position and size of the recesses 28 and 30 are equal. Six projections 32 are formed on the inner periphery of the groove 22 of the fastening ring 20, distributed uniformly over the inner periphery, in a manner corresponding to the recesses 28 and 30 formed on the widenings 19 and 21. The projections 32 extend radially inwards. In the assembled condition, the projections 32 of the fastening ring 20 engage with a positive fit into the recesses 28 of the widening 19 as well as into the recesses 30 of the widening 21 and thus prevent a rotational movement of the seal 12 relative to the impeller 4.

Figure 5:
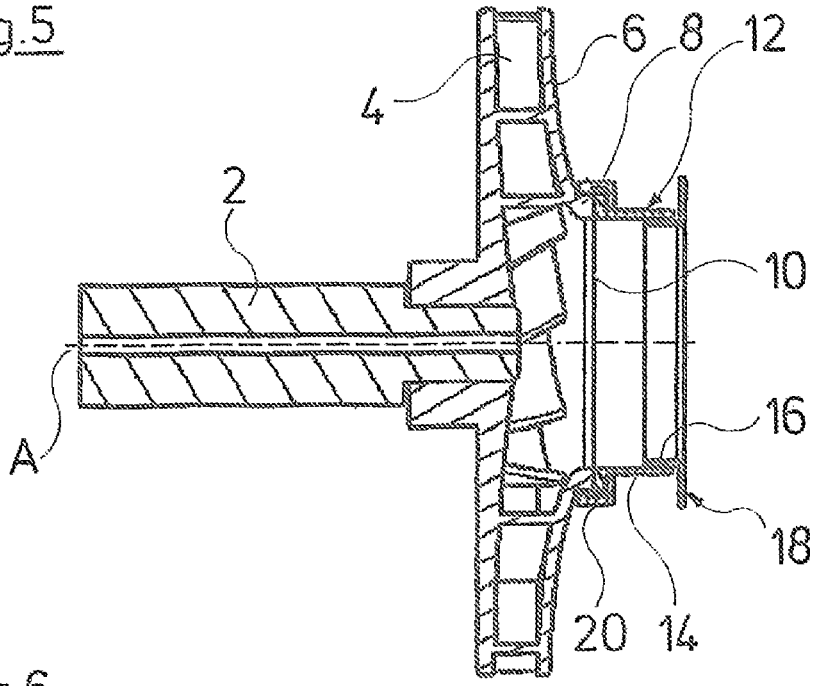
FIG. 5 is a schematic longitudinal section representation of an impeller of a centrifugal pump, with a sealing arrangement arranged thereon, in accordance with a third preferred embodiment of the present invention.
Figure 6:
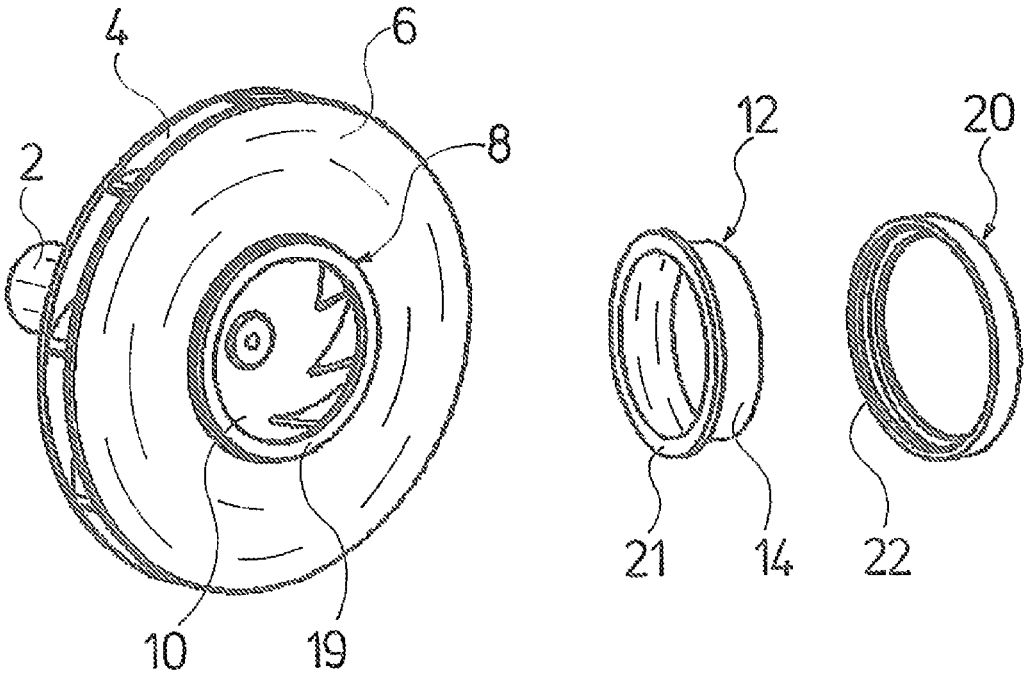
FIG. 6 is an exploded perspective representation of the impeller of FIG. 5.

With the embodiment example represented in FIGS. 5 and 6, projections or recesses are formed neither on the end-side nor on the peripheral side of the widenings 19 and 21. Here, the rotationally fixed arrangement of the seal 12 on the end 8 of the impeller 4 is effected by way of a non-positive fit. For this purpose, the end-faces and peripheral surfaces of the widenings 19 and 21 as well as the region of the groove 22 of the fastening ring 20, said region contacting these sides, form a friction pairing which prevents a rotation of the seal 12 relative to the impeller 4.

Figure 7:
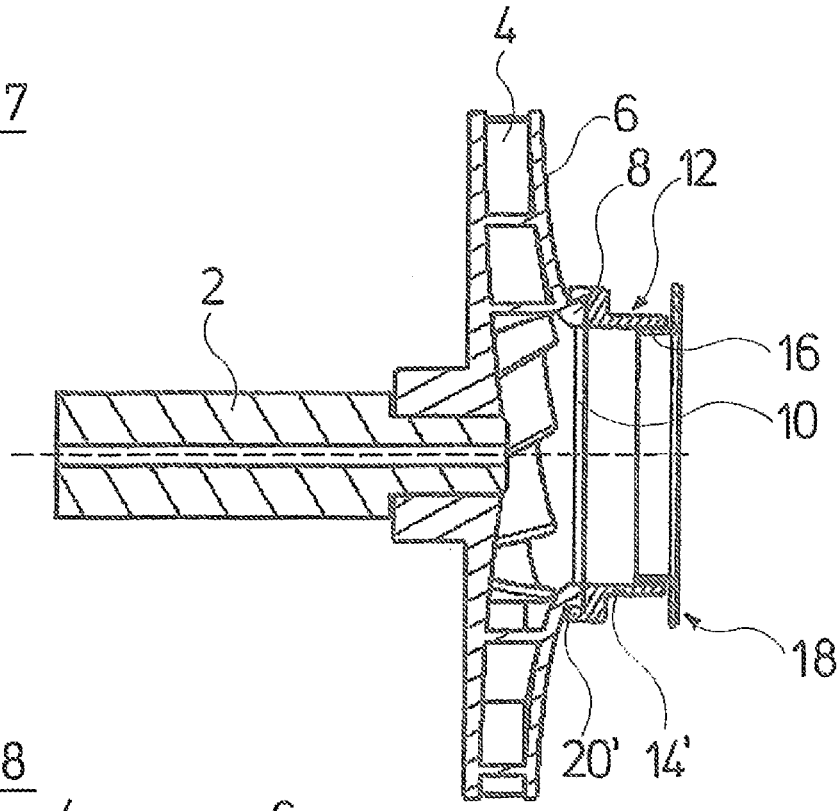
FIG. 7 is a schematic longitudinal section representation of an impeller of a centrifugal pump, with a sealing arrangement arranged thereon, in accordance with a fourth preferred embodiment of the present invention.
Figure 8:
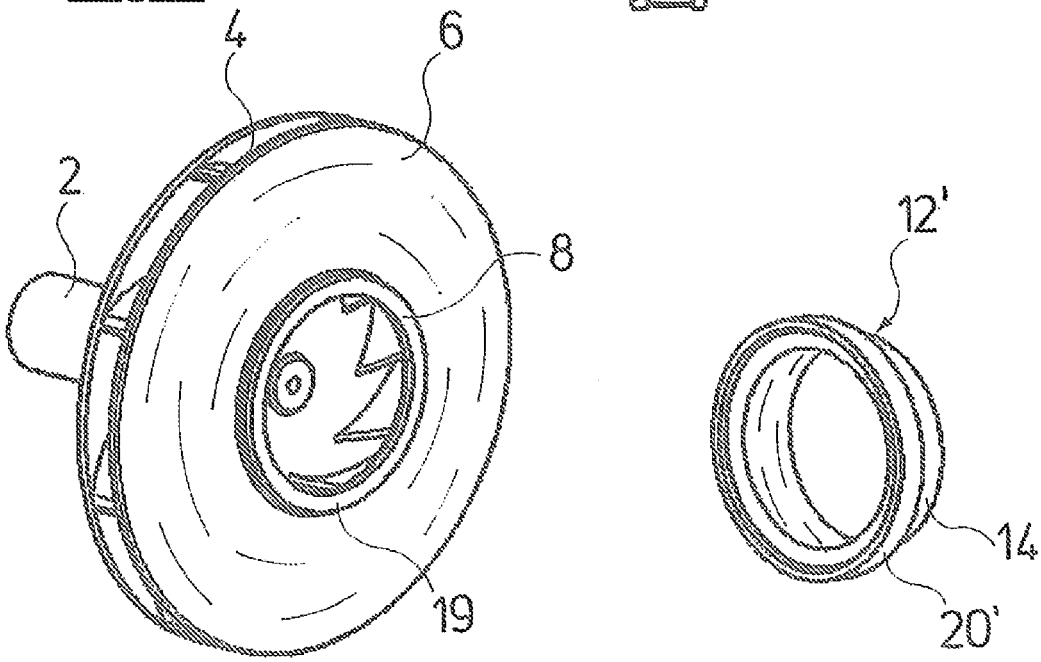
FIG. 8 is an exploded perspective representation of the impeller of FIG. 7.

In a similar manner, the seal 12 is fixed in a rotationally fixed manner on the end 8 of the impeller 4 by way of a friction fit, in the embodiment example represented in FIGS. 7 and 8. However, here a seal 12' is provided, with which the one hollow-cylindrical base body 14' and a fastening ring 20' form an integral component, thus are fixedly connected to one another.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A centrifugal pump with at least one impeller (4) and with at least one sealing arrangement arranged between the impeller (4) and a housing wall, said sealing arrangement sealing a suction side of the impeller (4) with respect to a pressure side of the impeller (4), the sealing arrangement comprising a seal (12) fastened on the impeller (4) in a rotationally fixed manner and displaceable as a whole in the radial direction relative to the impeller during operation of the pump (4).

2. The centrifugal pump according to claim 1, wherein the seal (12) is designed in a flexible manner at least in sections.

3. The centrifugal pump according to claim 1, wherein the seal (12) is arranged on a suction port (10) of the impeller (4) and comprises a hollow-cylindrical section (14) which extends in the axial direction.

4. The centrifugal pump according to claim 3, wherein a stationary part (16) of the sealing arrangement is designed in a sleeve-like manner and engages into the hollow-cylindrical section (14) of the seal (12).

5. The centrifugal pump according to claim 3, wherein the seal (12) is fastened on the impeller (4) with a fastening ring (20) which is designed in a flexible manner.

6. The centrifugal pump according to claim 5, wherein an end of the seal (12) as well as an end (8) of the suction port (10) comprise outwardly projecting, flange-like widenings (19, 21) which engage into an inner groove (22) of the fastening ring (20) applied around the widenings (19, 21).

7. The centrifugal pump according to claim 5, wherein the fastening ring (20) holds the seal (12) on the impeller (4) with radial play.

8. The centrifugal pump according to claim 6, wherein the seal (12) is connected to the impeller (4) in a rotationally fixed manner by way of a positive-fit.

9. The centrifugal pump according to claim 8, wherein at least one engagement means is formed on a side of the seal (12), said side facing the suction port (10), and the at least one engagement means is in engagement with corresponding engagement means on the impeller (4).

10. The centrifugal pump according to claim 8, wherein at least one radially aligned projection (32) is formed in the inner groove (22) of the fastening ring (20), and the projection (32) engages into corresponding radial recesses (28, 30) of the suction port (10) or seal (12).

11. The centrifugal pump according to claim 3, wherein the seal (12) is connected to the suction port (10) in a rotationally fixed manner by way of a non-positive fit.

12. The centrifugal pump according to claim 5, wherein the seal (12) and the fastening ring (20) are designed as an integral component.

* * * * *